US009629398B2

(12) United States Patent
Goryl

(10) Patent No.: US 9,629,398 B2
(45) Date of Patent: Apr. 25, 2017

(54) FRONT-BACK PACK

(71) Applicant: William Goryl, San Anselmo, CA (US)

(72) Inventor: William Goryl, San Anselmo, CA (US)

( * ) Notice: Subject to any disclaimer, the term of this patent is extended or adjusted under 35 U.S.C. 154(b) by 385 days.

(21) Appl. No.: 14/162,703

(22) Filed: Jan. 23, 2014

(65) Prior Publication Data

US 2014/0203057 A1 Jul. 24, 2014

Related U.S. Application Data

(60) Provisional application No. 61/755,468, filed on Jan. 23, 2013.

(51) Int. Cl.

| | |
|---|---|
| ***A45F 3/04*** | (2006.01) |
| ***A41D 13/00*** | (2006.01) |
| ***A45F 3/14*** | (2006.01) |
| *A45F 5/00* | (2006.01) |
| *A45F 3/00* | (2006.01) |

(52) U.S. Cl.

CPC ..... *A41D 13/0012* (2013.01); *A45F 3/14* (2013.01); *A45F 3/00* (2013.01); *A45F 5/00* (2013.01); *A45F 2003/146* (2013.01)

(58) Field of Classification Search

CPC ..... A45F 2003/045; A45F 3/08; A45F 3/14; A45F 2003/146; A45F 3/047

USPC ..... 224/632, 631, 637–641

See application file for complete search history.

(56) References Cited

U.S. PATENT DOCUMENTS

| | | | | | |
|---|---|---|---|---|---|
| 775,149 | A * | 11/1904 | Righton | A45F 5/02 | 224/195 |
| 1,601,624 | A * | 9/1926 | Houghton | A45F 5/00 | 224/195 |
| 5,437,403 | A | 8/1995 | Lemanski, II | | |
| 5,669,170 | A * | 9/1997 | Norris | F41C 33/00 | 224/150 |
| 6,152,338 | A * | 11/2000 | Smith | A01K 97/10 | 224/149 |
| 8,387,843 | B2 | 3/2013 | Kramer | | |
| 8,453,897 | B2 * | 6/2013 | Burton | A45F 3/04 | 224/199 |
| 9,084,470 | B1 * | 7/2015 | Huck | A45F 3/14 | |
| 2006/0213944 | A1 * | 9/2006 | Dieter | A45F 3/04 | 224/648 |
| 2007/0080183 | A1 * | 4/2007 | Lafoux | A45F 3/04 | 224/153 |

(Continued)

*Primary Examiner* — Adam Waggenspack

(74) *Attorney, Agent, or Firm* — Gary L. Eastman, Esq.; Eastman & McCartney LLP

(57) ABSTRACT

A Front-Back Pack that provides the ability to easily and quickly transition a pack from a back position to a front position without the need to remove the pack from the body of a user. The Front-Back Pack includes a harness system with attached pack. The harness system may include a system of straps to keep a plurality of looped slide rail assemblies in position and to prevent the slide rail assemblies from moving. Alternatively, the harness system may include a half-vest or full-vest with slide rail assemblies fixedly attached. The slide rail assemblies are formed to receive trucks able to traverse the track assembly. The trucks are fixedly attached to packs which allow the packs to traverse the length of the track assembly from one position to another without the need to remove the pack from the body of a user.

6 Claims, 13 Drawing Sheets

(56) References Cited

U.S. PATENT DOCUMENTS

2008/0277443 A1* 11/2008 Thiriot ..... A45F 3/04
224/638

* cited by examiner

FRONT-BACK PACK

RELATED APPLICATION

This application claims the benefit of priority to U.S. Provisional Patent Application Ser. No. 61/755,468 for a "Front-Back Pack" filed Jan. 23, 2013, and incorporated fully herein by this reference.

FIELD OF THE INVENTION

The present invention relates generally to a storage pack. The present invention is more particularly, though not exclusively, useful as a storage pack having the ability to easily and quickly transition from the back of a user to the front of the user without the need to remove the storage pack from the user's body.

BACKGROUND OF THE INVENTION

Backpacks are being used extensively by a wide variety of people and for a wide range of activities. They can be seen every day in urban, suburban, and rural areas and are used by people from all walks of life. Some of the most common users of backpacks include school children, hikers, campers, bicyclists, travelers, skiers, and snowboarders, with each user using the backpack for a different purpose. School children utilize backpacks to carry their books, lunches, school supplies, and sports gear while hikers and campers use backpacks to carry clothing, food, water, and camping supplies.

The universal use of backpacks is partly due to it being an inexpensive and effective means to carry goods by an individual person. As a result, there are many variations of backpacks to fit the individual person's needs. The sizes of the backpacks vary in size from small to large. Some have multiple compartments, some have internal or external frames, some have padding, and some have liquid-carrying bladders. Many have multiple ways to adjust to the wearer's body. Additionally, they come in all sorts of colors and patterns. Most backpacks effectively distribute the load of the goods contained in the backpack to the wearer's shoulders and waist, making it relatively comfortable to carry the items for reasonable periods of time.

Despite their popularity and usefulness, however, backpacks have certain disadvantages. It is difficult and uncomfortable to sit on a chair or bench with a backpack on. This is a common complaint of skiers and snowboarders, who must ride on chair-lifts many, many times in the course of a day on the slopes. Often the skier or snowboarder will sit way forward on the seat to allow room for the backpack, sitting in an awkward and possibly dangerous position. Alternatively, they will remove the backpack and hold it in his or her hands while dealing with the ski lift, gloves, ski poles, and other associated equipment. This also introduces the risk of dropping the pack and its contents. Additionally, people sitting on a bus or a bench, such as urban travelers and school children must remove their backpacks to sit or keep the backpack on and sit in an uncomfortable manner.

Furthermore, it is difficult or impossible to access the contents of a backpack without first removing it. To access the contents, the backpack must be removed and set on the ground or elsewhere, or the user must hold it in one hand while accessing the contents with the other hand. Additionally, a person on a bicycle would have to stop and remove their backpack to access the contents of the backpack as well.

In light of the above, it would be advantageous to provide a pack which allows a user to access the contents of the pack without the need to remove the pack from the user's body. It would further be advantageous to provide a pack which could be worn by a user and have the ability to quickly and easily transition between the back of the user and the front of the user.

SUMMARY OF THE INVENTION

The Front-Back Pack of the present invention allows a user to access the contents of the Front-Back Pack without the need to remove it from the user's body. The storage compartment, referred to as the pack, can be easily and quickly transitioned from the back to the front of the wearer's body without removing the pack, without removing any straps, and while being continuously supported. While the pack is in the front of the wearer's body, the contents can be readily accessed, and the wearer can sit comfortably and safely, whether on a chair lift or other type of seat. When the goods are accessed from the pack and the wearer wishes to return the pack to his or her back position, they simply push the pack back to its original position.

In the preferred embodiment, the Front-Back Pack is constructed with a harness system which supports the pack. The harness system includes one or more slide rail assemblies wrapped around a user's body which allows an attached pack to transition from the front of a user to the back of a user. In the preferred embodiment, the slide rail assemblies are constructed to receive a truck and allow the truck to traverse the track with ease and very little force. Alternatively, the track and trucks may be constructed of a variety of materials and may be in a number of different configurations to allow for translational movement, while at the same time supporting the pack on the user's body. One possible configuration of the track is flexible plastic rod, such as polyethylene, wrapped with fabric to constrain it to the harness ("piping"). A plastic or metal clip could slide along the rod. Other track variations might include multiple linked elements, and the trucks might slide along the track, or might have wheels to facilitate easy movement. The packs are fixedly attached to the trucks, allowing the packs to traverse the slide rail assemblies. The slide rail assemblies are supported by a plurality of straps configured and positioned to wrap around a user's body, specifically the shoulders. Alternatively, the slide rail assemblies may be fixedly attached to a full-vest or a half-vest and strap combination.

In an alternative embodiment, the Front-Back Pack is constructed with a belt harness system having attached packs. The belt harness system includes a pair of notched belts held together with a chest piece and a back piece. Fixedly attached to the belts are a first pack and a second pack, respectively. The notched belts with attached packs are able to advance through the chest and back piece, allowing the packs to transition from the back to the front and vice versa.

In another alternative embodiment, the Front-Back Pack has a harness system with attached shoulder mounts and a pack with an attached frame. The frame of the pack is rotatably attached to the shoulder mounts and allows the pack to transition from the back to the front and vice versa.

In another alternative embodiment, the Front-Back Pack is a vest having an attached track system and a plurality of packs attached to the track system. The track system includes a track rigidly attached to the vest and the packs have a loop wherein the track is inserted into the loop of the pack. The packs are advanced along the track by sliding the loop along the track.

In another alternative embodiment, the Front-Back Pack includes a vest with packs hingedly attached to either side of the best. The packs rotate about the hinge from a front position to a back position and vice versa. The packs have straps attached to the top, allowing the packs to be secured in place by fastening the straps to the shoulder area of the vest.

In another alternative embodiment, the Front-Back Pack includes a vest with a neck track attached. The packs are attached to the neck track and traverse the neck track from a front position to a back position.

DESCRIPTION OF THE DRAWING

The objects, features, and advantages of the apparatus of the present invention will be more clearly perceived from the following detailed description, when read in conjunction with the accompanying drawing, in which.

DETAILED DESCRIPTION

Figure 1:
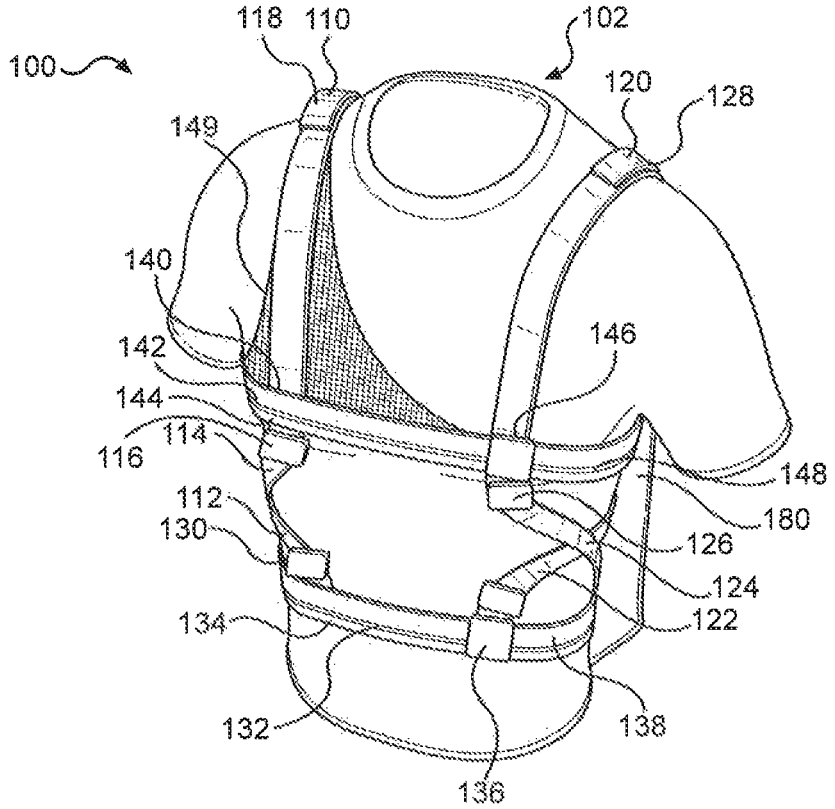
FIG. 1 is a perspective view of the preferred embodiment of the present invention, the Front-Back Pack showing dual slide rails supported by the shoulder straps.

Referring initially to FIG. 1, a perspective view of the preferred embodiment, the Front-Back Pack of the present invention is shown and generally designated 100. The Front-Back Pack 100 includes a harness system 102 and an attached slidable pack 180.

The harness system 102 is a system of interconnected straps, buckles, clips, and various other pieces which allows the secure and removable attachment of the harness system 102 and attached slidable pack 180 to a user. The harness system 102 has a first shoulder strap 110 and a second shoulder strap 120. The first shoulder strap 110 is made of a sturdy and flexible material such as nylon, polyester, or any other materials having similar characteristics. The shoulder strap 110 has a stationary strap 112 and an adjustable strap 114. One end of the stationary strap 112 is attached to a lower slide rail assembly 130 and the opposite end of the stationary strap 112 is a slide 116. Removably attached to slide 116 is adjustable strap 114. The slide 116 allows the adjustable strap 114 to adjust to the appropriate length and held in place. The opposite end of adjustable strap 114 is attached to the lower slide rail assembly 130. The stationary strap 112 and adjustable strap 114 are connected to form the first shoulder strap 110. At the apex of the stationary strap 112 has shoulder padding 118 to spread the load of the Front-Back Pack 100, giving the user a more comfortable strap.

The first shoulder strap 110 and the second should strap 120 are substantially similar and serve substantially the same purpose. The second shoulder strap 120 has a stationary strap 122 attached to the lower slide rail assembly 130 and wraps around a user to form a loop terminating at a slide 126. Attached to the slide is adjustable strap 124, which is attached to lower slide rail assembly 130. The stationary strap 122 and adjustable strap 124 are connected to form the second shoulder strap 120. The secondary shoulder strap 122 has shoulder padding 128 as well.

The lower slide rail assembly 130 has a predetermined length to allow the lower slide rail assembly 130 to encircle the lower torso of a user. The overall length of the lower slide rail assembly 130 may be adjusted for various applications and users. Lower slide rail assembly 130 has a track assembly 132 rigidly attached to a backing 134 by the use of stitches, rivets, bolts or any similar methods available and known in the art now or in the future. One end of the backing 134 has an adjustable buckle 136 and the opposite end has an adjustable strap 138. The adjustable strap 138 is inserted into the adjustable buckle 136 and forms a complete loop, where adjustable strap 138 allows the variation in the length of the loop by extending or shortening the amount of the adjustable strap 138 is pulled through the buckle 136. The buckle 136 may be a snap-lock buckle, cam buckle, release buckle, or any other type of mechanism allowing the quick detachment and adjustment of the loop by engaging or disengaging the buckle 136.

Attached to the stationary straps 112 and 122 of the first shoulder strap 110 and second shoulder strap 120 is an upper slide rail assembly 140. The upper slide rail assembly 140 is substantially similar to the lower slide rail assembly 130 and includes a track assembly 142 attached to a backing 144 having a buckle 146 at one end and an adjustable strap 143 at the opposite end. The upper slide rail assembly 140 is attached to the first stationary strap 112 and second stationary strap 122 at substantially the same location along the upper slide rail assembly 140 as the lower slide rail assembly 130. By having the upper slide rail assembly 140 and lower slide rail assembly 130 attached at substantially the same location along the length, the harness system 102 provides greater stability when worn. A mesh webbing 149 is attached to the first shoulder strap 110 and the upper slide rail assembly 140 to increase the stability of the upper slide rail assembly 140.

Figure 2:
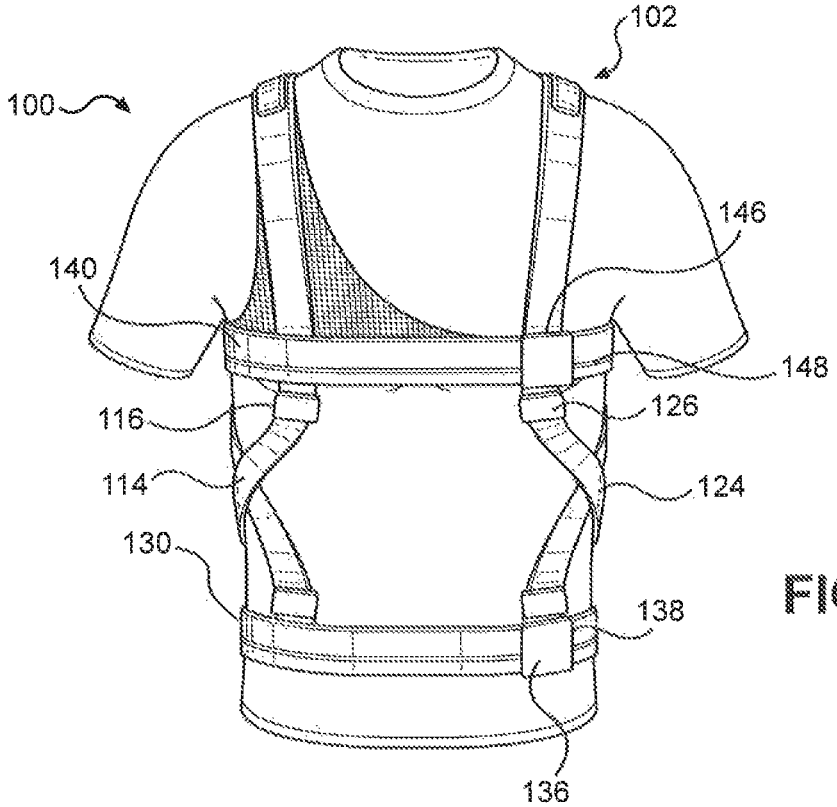
FIG. 2 is a front view of the Front-Back Pack showing the dual slide rails supported by the shoulder straps.

Referring now to FIG. 2, a front view of the Front-Back Pack 100 of the present invention is shown. For ease of removal, the various clips, buckles, and latches of the Front-Back Pack 100 are located at the front. The buckle 146 of the upper rail assembly 140, the buckle 136 of the lower rail assembly 130, the adjustable buckle 116 and adjustable strap 114 of the first shoulder assembly, the adjustable buckle 126 and adjustable strap 124 of the second shoulder assembly are located in the front to allow a user to easily adjust or remove the harness system 102. By adjusting the various straps and buckles, a user can securely attach the harness system 102 to the user's body.

A user can adjust the length of the upper rail assembly 140 to fit around the user's chest by adjusting the length of the adjustable strap 148. A user can adjust the length of the lower rail assembly 130 to fit around the user's torso by adjusting the length of the adjustable strap 138. The size of the first shoulder strap 110 and second shoulder strap 120 can be adjusted through the slide 116 and 126, respectively. For quick and easy removal of the harness system 102, a user disengages adjustable buckle 136 and adjustable buckle 146 and slides the first shoulder strap 110 and second shoulder strap 120 off. To put the harness system 102 on, a user slides on the first shoulder strap 110 and second shoulder strap 120 on and then engages the adjustable buckle 136 and adjustable buckle 146.

Figure 3:
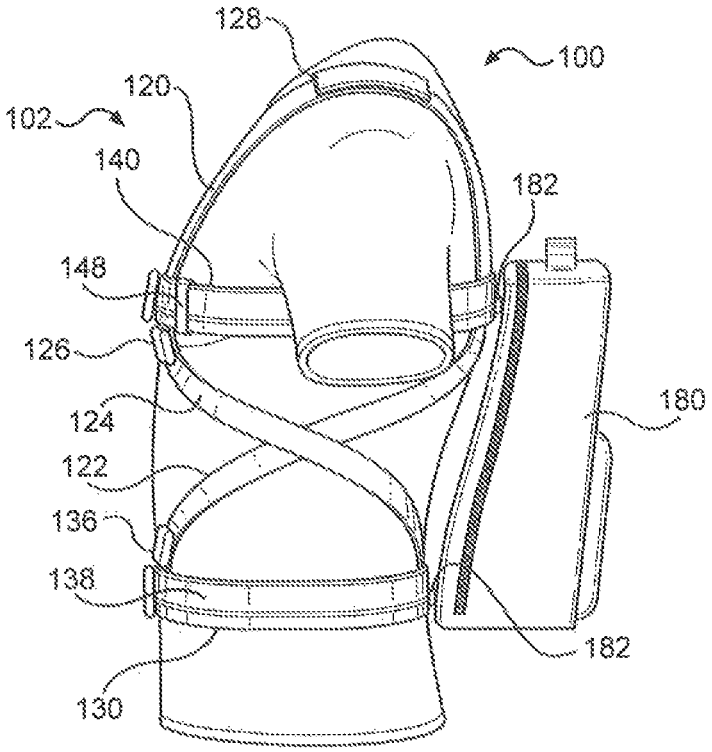
FIG. 3, is a side view of Front-Back Pack showing the shoulder strap having a loop crossed to attach to the lower slide rail at two points, and the upper slide rail attached to the loop of the shoulder strap at two points, with a pack attached to the upper and lower slide rails.

Referring now to FIG. 3, a side view of the preferred embodiment the Front-Back Pack 100 of the present invention is shown. The second shoulder strap 120 is connected to the lower slide rail assembly 130 and upper slide rail assembly 140 at two locations. The stationary shoulder strap 122 is connected at the front of the lower slide rail assembly 130 and forms a loop where the adjustable strap 124 is then attached to the slide 126 of the stationary shoulder strap 122 and then rigidly attached to the back of the lower slide rail assembly 130, resulting in a crisscross pattern of the second shoulder strap 120 as shown. The resulting crisscross pattern results in a truss-like structure to provide strength and stability to the harness system 102. The stationary shoulder strap 122 is rigidly attached to the upper rail assembly 140 at the front and the back to provide additional points of attachment for stability and strength. The first shoulder strap 110 is constructed and configured in a substantially similar manner as second shoulder strap 120 and also has a crisscross pattern resulting in a truss-like structure.

Pack 180 is slidably attached to the upper slide rail assembly 140 and lower slide rail assembly 130. Pack 180 has four attachment points, two attachments points for the upper slide rail assembly 140 and two attachment points to the lower slide rail assembly 130. The utilization of two attachment points is not meant to be limiting and any number of attachment points may be utilized. Each attachment point on pack 180 is a truck 182 rigidly attached to the backside of the pack 180. The trucks 182 are attached to each back-side corner of pack 180 and allow pack 180 to slide along the upper slide rail assembly 140 and lower slide rail assembly 130 from a back position to a front position. At the location of the back position a series of friction locks (not shown) located along the upper slide rail assembly 140 and lower slide rail assembly 130 keep pack 180 in place. The use of friction locks is not meant to be limiting and the use of alternative locking mechanism to keep pack 180 in place are contemplated, such as snap locks, levers, magnets and any other types of mechanism which would accomplish the same.

As shown, the top of pack 180 is installed on the harness system 102 to be in line with the upper slide rail assembly 140. This allows the pack 180 to easily pass under the arm of a user without the need for excessive articulation of the arm. Alternatively, the pack 180 may be made larger and installed where the top of the pack 180 is higher than the upper slide rail assembly 140. A user passes the pack 180 from the back position to the front position by first lifting the users arm parallel to the side of the body and then pulling the pack 180 along the slide rail assembly 140.

Figure 4:
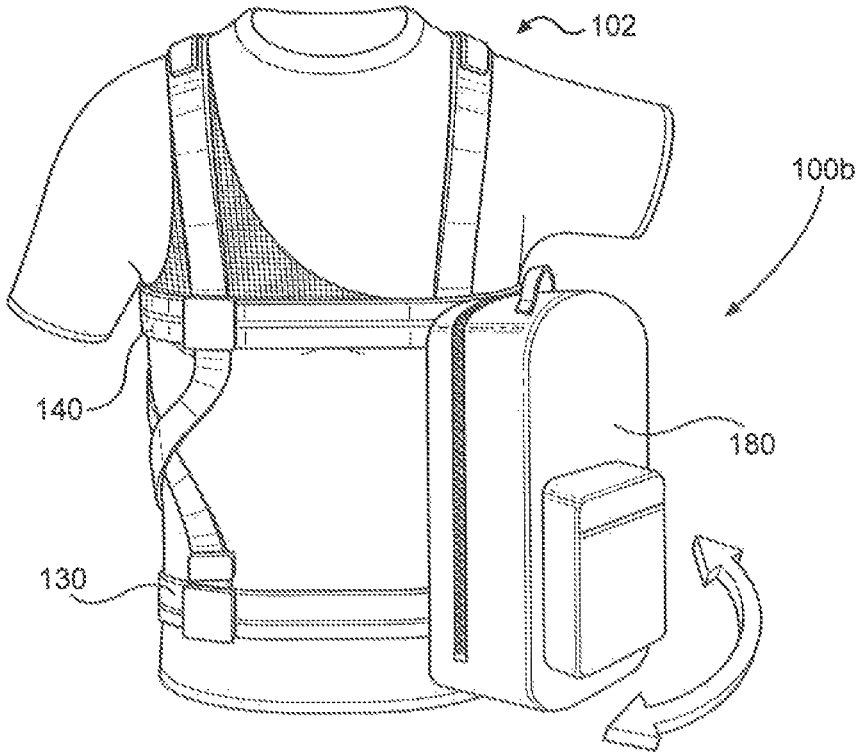
FIG. 4 is a front view of the Front-Back Pack of the present invention with attached pack being transitioned from the back position to the front position.

Referring now to FIG. 4, a front view of an alternative embodiment of the Front-Back Pack 100*b* of the present invention is shown. The Front-Back Pack 100*b* as shown in FIG. 4 is substantially similar to the Front-Back Pack 100 of FIG. 1, the difference being the positioning of the upper slide rail assembly 140 and lower slide rail assembly 130. As shown, the Front-Back Pack 100*b* is configured for the pack 180 to be pulled from the back position to the front position from the right, whereas the Front-Back Pack 100 is configured to be pulled from the left. The pack 180 is locked in the back position and a user may pull the pack 180 to the front position for use by grabbing onto the pack 180 and pulling it around. The attached trucks 182 allow the pack 180 to smoothly glide along the upper slide rail assembly 140 and lower slide rail assembly 130.

Figure 5:
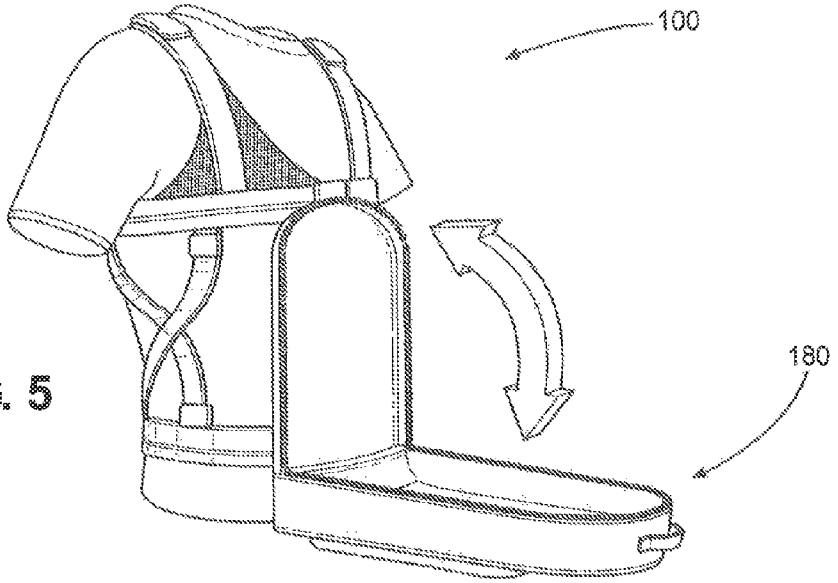
FIG. 5 is an isometric view of Front-Back Pack in the front position with the pack opened to allow a user to gain access to the interior of the Front-Back Pack.

Referring now to FIG. 5, a perspective view of the preferred embodiment, the Front-Back Pack 100, of the present invention is shown. The pack 180 is in the front position and opened to allow a user to gain access to the interior of pack 180 without the need to remove the Front-Back Pack 100 from the user's body. In the preferred embodiment, the pack 180 is configured for general use. However, it is contemplated that pack 180 may be configured for specific uses as well. Pack 180 may be a laptop pack, a hydration pack, a camping pack, or any other storage compartment contemplated by those skilled in the art. As a laptop pack, a user may flip open the pack and use the pack as a free-standing table for the laptop. This allows a user to use the laptop in any situation.

Figure 6:
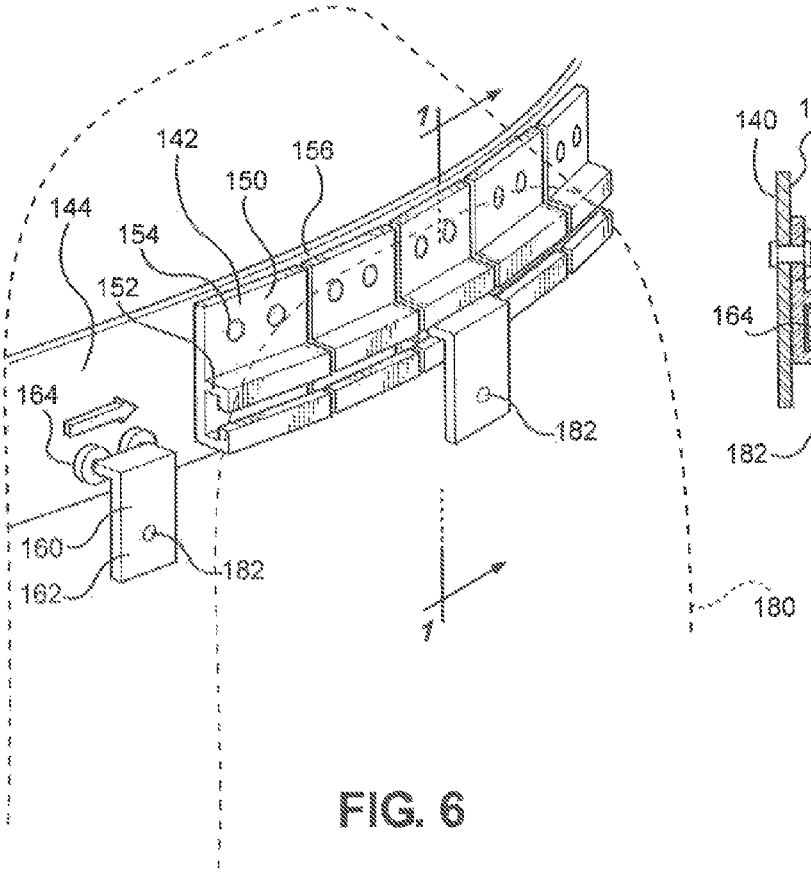
FIG. 6 is a close-up perspective view of a slide rail showing the individual track partitions arranged and attached to a semi-rigid back to form the slide rail and a truck having a plurality of rolling elements disposed with the individual tracks to allow the truck to easily and quickly traverse the slide rail and an attachment points for a pack.

Referring now to FIG. 6, a close-up perspective view of the upper slide rail assembly 140 is shown. The upper slide rail assembly 140 has a track assembly 142 rigidly attached to a backing 144. In the preferred embodiment, the track assembly 142 is made of numerous individual tracks 150. An individual track 150 is a C-channel 152 formed with a flange 154 extending therefrom. The flange 154 is rigidly attached to the backing 144 and arranged along a central axis which configures the C-channels 152 of each individual track into a linear channel. The tracks 150 are made up of any rigid and durable material such as plastic, metal, or any other material with similar properties. Between each individual track 150 are gaps 156 to allow the backing 144 to retain its flexibility. The flexibility of the backing 144 allows greater comfort for the user when the Front-Back Pack 100 is worn. It is contemplated that in an alternative embodiment, the track assembly 142 may be made of a continuous track rather than made of individual tracks. The material used for the continuous track will be made of a less rigid material to maintain flexibility of the track assembly 142.

Truck 160 has a body with a cross-section shape of an L, having a short member and a long member. Attached to the edge of the short member is a plurality of wheels 164 which are configured to rotate. Attached to long member is a pin 162 which attaches the truck 160 to the pack 180. The wheels 164 are inserted into the C-channel 152 of the track assembly 142 and are retained within the C-channel 152. The wheels 164 glide smoothly across each individual C-channel 152. To allow easier movement, the truck 164 is formed with a slight curve along the axis of travel. The use of the track and truck assembly is not meant to be limiting and other types of slide rails are contemplated, such as a belt and loop apparatus.

Figure 7:
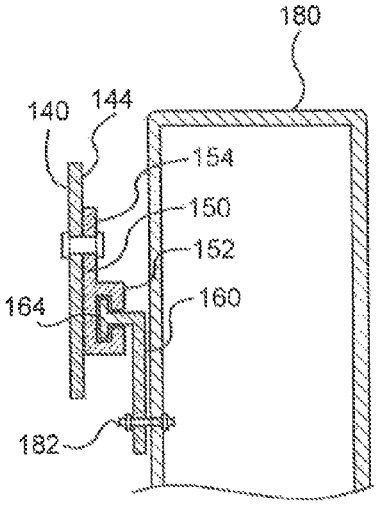
FIG. 7 is a cross-section view of the attached slide rail having a truck placed within the slide rail.

Referring now to FIG. 7, a cross-sectional view of the upper track assembly 140 taken at cross-section 1-1 is shown. The flange 154 of the track 150 is rigidly attached to the backing 144 using rivets, bolts, stitching or other similar fastening methods. The wheels 164 attached to the truck 160 are inserted into the C-channel 152 of the track 150. The pack 180 is attached to the truck 160 using rivets 182 or alternatively, bolts, stitching or other similar fastening methods.

Figure 8:
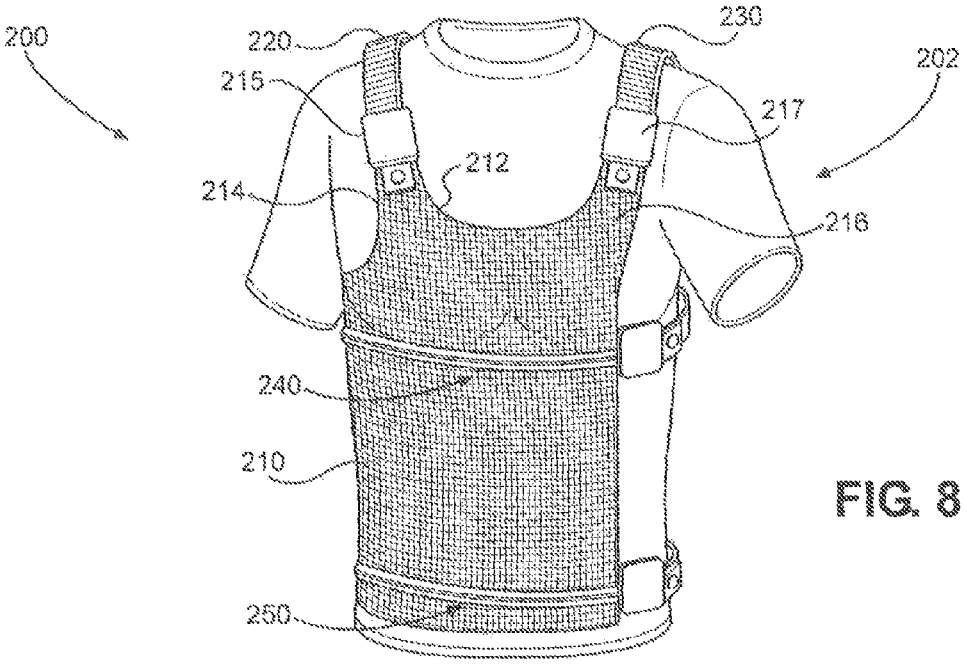
FIG. 8 is a right side, perspective view of an alternative embodiment of the Front-Back Pack of FIG. 1 having a half vest with attached upper and lower slide rails.

Referring now to FIG. 8, a perspective view of an alternative embodiment of the Front-Back Pack of the present invention is shown and generally designated 200. The Front-Back Pack 200 includes a vest harness system 202 and a slidable pack 180. The vest harness system 202 includes a vest 210, an upper slide rail assembly 240 and a lower slide rail assembly 250.

The vest 210 includes a first shoulder strap 220 and a second shoulder strap 230. Vest 210 has neck line 212 with a first shoulder section 214 having an attached adjustment buckle 215 and a second shoulder portion 216 having an attached adjustment buckle 217. Vest 210 is made of lightweight and strong material with the ability to allow body heat to escape such as polyester, cotton, nylon or any other material with the same or similar physical properties known in the art. As shown vest 210 covers only the front half of a user, however, it is contemplated that the vest may cover the full upper body of a user and includes a zipper to quickly and easily remove the vest.

Attached below the neckline 212 of the vest 210 is upper slide rail assembly 240 and attached towards the bottom is lower slide rail assembly 250. The upper slide rail assembly 240 and lower slide rail assembly 250 is substantially similar to the upper slide rail assembly 140 and lower slide rail assembly 130 of Front-Back Pack 100 and therefore the description is incorporated herein for upper slide rail assembly 240 and lower slide rail assembly 250. One end of first shoulder strap 220 is connected to the adjustment buckle 215 and the opposite end is fixedly attached the upper slide rail assembly 240. One end of a second shoulder strap 230 is connected to the adjustment buckle 217 and the opposite end is fixedly attached to the upper slide rail assembly 240. The adjustable buckles, 215 and 217, allow a user to adjust the shoulder straps 220 and 230 to fit the user's shoulders. The upper slide rail assembly 240 and lower strap assembly 250 is adjusted in the same manner as described previously.

The vest 210 provides a large contact surface area to the front of the body and the first shoulder strap 220 and second shoulder strap 230 keeps the vest at the appropriate height against the user's body. The upper slide rail assembly 240 and the lower slide rail assembly 250 keeps the vest 210 tight against the body which in turns keeps the vest harness system 202 firmly attached to a user.

Figure 9:
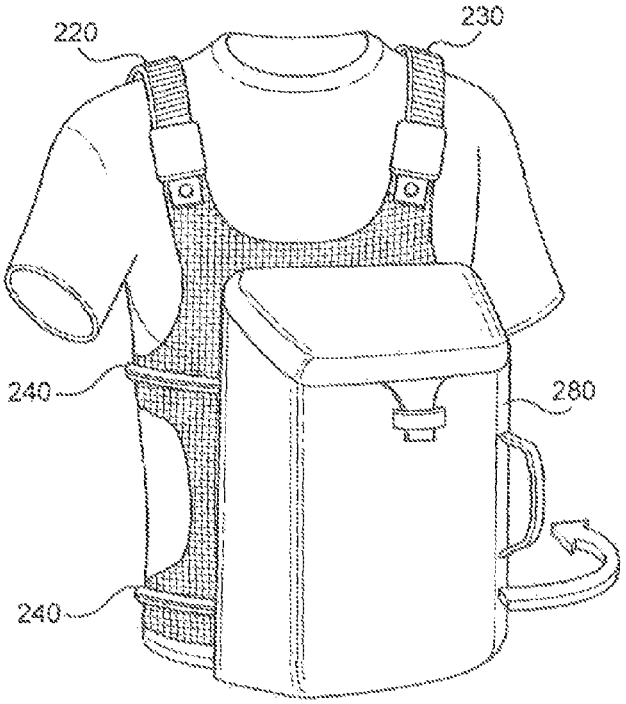
FIG. 9 is a left side, perspective view of the alternative embodiment of FIG. 8, showing the attached pack in the front position.

Referring now to FIG. 9, a front view of Front-Back Pack 200 is shown. The pack 280 is the same as pack 180 shown and described in FIG. 1 of the Front-Back Pack 100. The pack 280 is interchangeable between any and all of the two rail Front-Back Pack embodiments. The pack 280 is in the front position to allow a user to gain access to the interior of pack 280 without the need to remove the Front-Back Pack 200 from the user's body.

Figure 10:
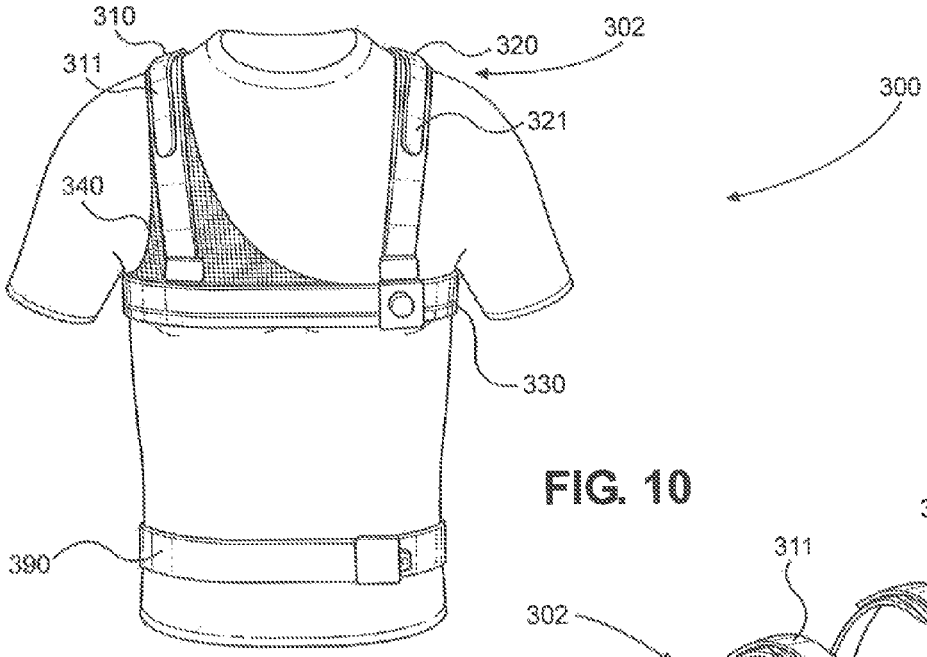
FIG. 10 is a front view of an alternative embodiment of the Front-Back Pack having a single slide rail attached to shoulder straps.

Referring now to FIG. 10, a front view of an alternative embodiment of the Front-Back Pack of the present invention is shown and generally designated 300. The Front-Back Pack 300 is a single slide rail assembly version of the preferred embodiment as shown in FIG. 1. The Front-Back Pack 300 includes a shoulder harness system 302 and a pack 380.

The shoulder harness system 302 includes a single slide rail assembly 330, a first shoulder strap 310, and a second shoulder strap 320. One end of the first shoulder strap 310 is rigidly attached to the front of the single slide rail assembly 330 and the opposite end is attached to the back.

The second shoulder strap 320 is attached in a similar manner. Mesh 340 is connected between the first shoulder strap 310 and the single slide rail assembly 330 to increase the strength and stability of the shoulder harness system 302. To further increase the stability of the pack, shoulder stabilizers 311 and 321 are attached to the first shoulder strap 310 and second shoulder strap 320, respectively. The shoulder stabilizers 311 and 321 stiffen the shoulder straps, to prevent the straps from rolling off the shoulders due to the weight of the pack.

Figure 11:
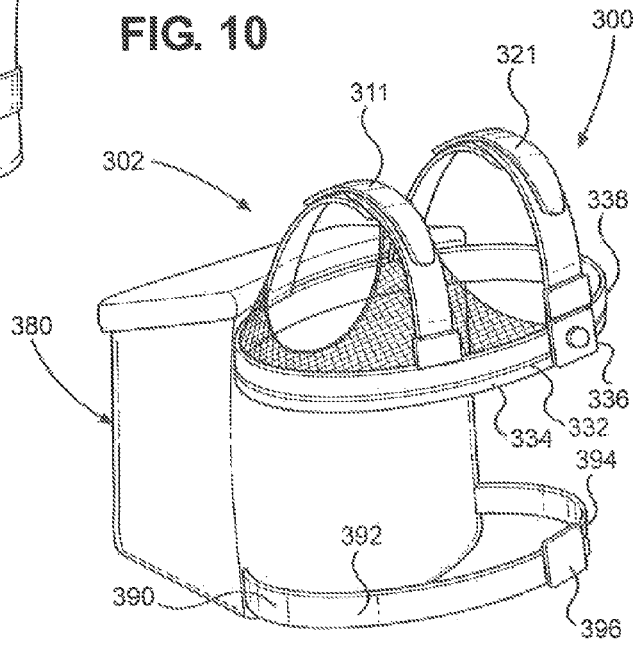
FIG. 11 is perspective view of the alternative embodiment of FIG. 10 showing the single slide rail attached to the shoulder straps and forming a loop with attached pack.

In this embodiment, the weight of the pack 380 is carried entirely on the single slide rail assembly 330. The single slide rail assembly 330 does not need to completely encircle the user's body—it need only allow the pack 380 to move from a position centered on the user's back to a position centered on the front of the user's body. The pack 380 has an attached adjustable belt 390 to restrain the pack 380 from swinging away from the user's body. This belt 390 rotates around the user's waist as the pack 380 is moved from front to back and vice versa Referring now to FIG. 11, a perspective view of the Front-Back Pack 300 is shown without the upper body of a user. The single slide rail assembly 330 is substantially similar to the upper slide rail assembly 140 of the Front-Back Pack 100 of FIG. 1 and includes a track assembly 332 attached to a backing 334 having a buckle 336 at one end and an adjustable strap 338 at the opposite end. One end of the first shoulder strap 310 is rigidly attached to the front of the single slide rail assembly 330 and the opposite end is attached to the back. The second shoulder strap 320 is attached in a similar manner.

Pack 380 is attached to the single slide rail assembly 330 through the use of two trucks 382 (not shown) rigidly attached to the top corners of the pack 380. The use of two trucks is not meant to be limiting and that the use of multiple trucks is contemplated. This allows the pack 380 to slide along the single slide rail assembly 330 from the back position to the front position. Attached to the bottom of the pack 380 is a belt 390 having a stationary strap 392 and an adjustable strap 394. One end of the stationary strap 392 is attached to the bottom, back of the pack 380 and the opposite end has a buckle 396 attached. Attached to the buckle 396 is one end of the adjustable strap 394 with the opposite end of the adjustable strap attached to the bottom back of pack 380. The buckle 396 allows adjustment of the adjustable strap 394 to vary the length of the belt 390. The buckle 396 also allows the quick release of the adjustable strap 394 from the stationary strap 394 to allow the pack 380 to be removed from the body. The pack 380 can move from the back position to the front position without removing the belt 390.

Figure 12:
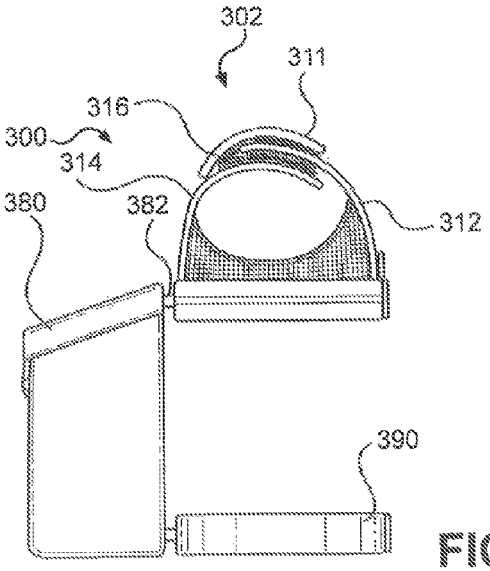
FIG. 12 is a side view of the alternative embodiment of FIG. 10 showing the adjustable shoulder strap attached to the slide rail with attached pack and waist belt restraint.

Referring now to FIG. 12, a side view of the Front-Back Pack 300 is shown. The shoulder harness system 302 includes a single slide rail assembly 330, a first shoulder strap 310 and a second shoulder strap 320. One end of the first shoulder strap 310 is rigidly attached to the front of the single slide rail assembly 330 and the opposite end is attached to the back. The first shoulder strap 310 has two sections, a front section 312 and a back section 314. One end of the front section 312 is attached to the front of the slide rail assembly 330 and the opposite end has Velcro 316 attached. One end of the back section 314 is attached to the back of the slide rail assembly 330 and the opposite end has Velcro 316 attached. Velcro 316 connects the front section 312 and back section 314 together to form the first shoulder strap 310 with the ability to adjust the length of the shoulder strap 310 by simply repositioning each section relative to one another. The shoulder stabilizer 311 is then attached to the top to provide additional structure and strength. The second shoulder strap 320 is substantially similar to the first shoulder strap 310 and has a front section 322, a back section 324, Velcro 326, and shoulder stabilizer 321. The use of Velcro is not meant to be limiting and other various fasteners may be used in place, such as buttons, snap locks, buckles, and any other type of fastening method.

Figure 13:
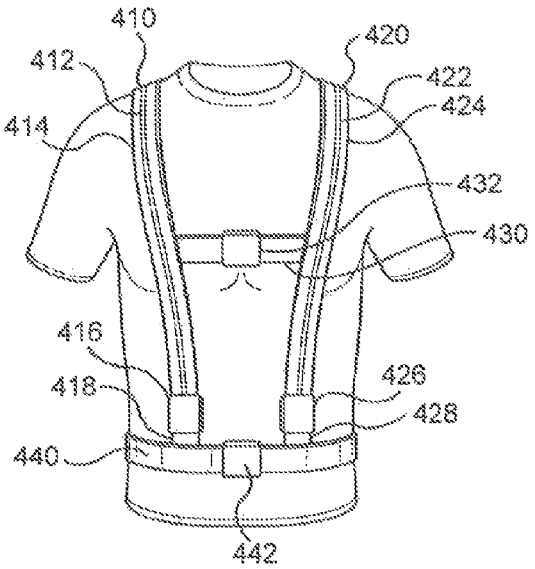
FIG. 13 is a front view of an alternative embodiment of the present invention showing adjustable slide rails attached along the shoulder straps and extending from the back to the front, terminating at a lower belt strap.

Referring now to FIG. 13, an alternative embodiment of the Front-Back Pack of the present invention is shown and generally designated 400. The Front-Back Pack 400 includes a harness system 402, a first pack 480 (not shown), and a second pack 490 (not shown).

The harness system 402 includes a first shoulder assembly 410, a second shoulder assembly 420, and a belt 440. The first shoulder assembly 410 extends from the front of the belt 440 to the back of the belt 440. The first shoulder assembly 410 includes a track assembly 412 rigidly attached to a backing 314. One end of the backing 414 is rigidly attached to the back of the belt and the opposite end terminates into an adjustable slide 416. An adjustable strap 418 is rigidly attached to the front of the belt 440 and is connected to the adjustable slide 416 to form the first shoulder assembly 410. The second shoulder assembly 420 is substantially similar to first shoulder assembly 410 and includes a track assembly 422, a backing 424, adjustable slide 426 and adjustable strap 428.

A sternum strap 430 attaches the first shoulder assembly 410 with the second shoulder assembly 420. The sternum strap 430 has a buckle 432 which allows the adjustment of the length of the sternum strap 430 as well as the quick disconnect of the sternum strap 430. The belt 440 is formed with a buckle 442 at the midpoint. The buckle 442 allows the length of the belt 440 to be adjusted as well as for the quick disconnect of the belt 440. By disconnecting the sternum strap 430 and belt 440, the harness system 402 is quickly and easily removed.

Figure 14:
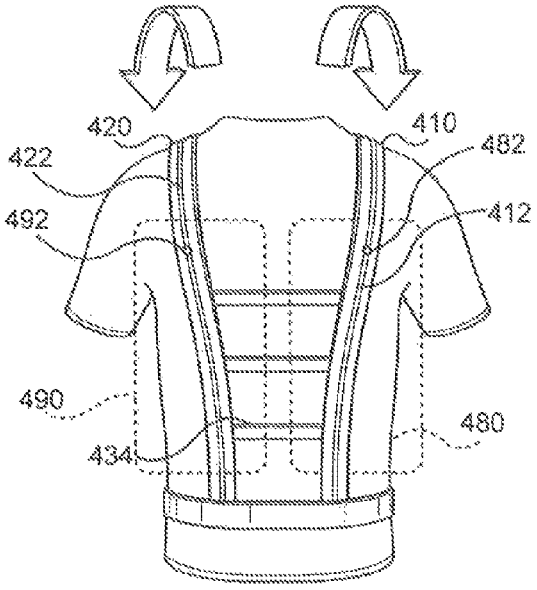
FIG. 14 is a front view of the alternative embodiment of FIG. 13, showing the attached double packs attached to the back of the user and shown in dashed lines.

Referring now to FIG. 14, a back view of the Front-Back Pack 400 of the present invention is shown. The first pack 480 and the second pack 490 are drawn in dashed lines to show the back of the harness system 402. The first pack 480 has a truck 482 rigidly attached to the top of the first pack 480. The structure of the truck 482 is substantially similar to the truck 160 described in FIG. 6, with a difference being instead of wheels 164 shown in FIG. 6, the truck 482 has an attached pivot ball to allow the truck 482 and attached first pack 480 to rotate. The truck 482 is slid into the track assembly 412 of the first shoulder assembly 410 and retained in place. The truck 482 allows the pack to be slid along the track assembly 412 from a back position to a front position without having to be removed from the harness system 402. The first pack 480 and second pack 490 are substantially similar. The second pack 490 includes a truck 492, rigidly attached to the top of the first pack 490, where the truck 492 is attached to the second shoulder assembly 420. A series of back straps 434 attach the first shoulder assembly 410 to the second shoulder assembly 420 to prevent them from splitting apart.

Figure 15:
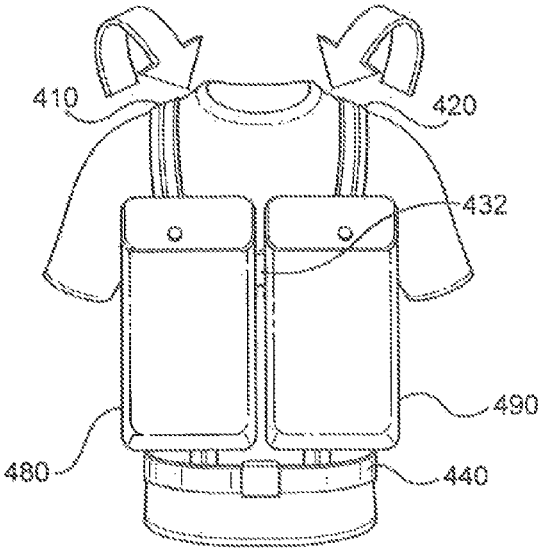
FIG. 15 is a front view of the alternative embodiment of FIG. 13, showing the double packs transitioned from a back position to a front position, where the double packs are individual packs.

Referring now to FIG. 15, a front view of the Front-Back Pack 400 is shown. The first pack 480 and second pack 490 are moved from the back position, over the shoulders, to the front position and rotated right side up. This allows a user to access the contents of the pack 480 or 490. The trucks 482 and 492 attached to the first pack 480 and second pack 490, respectively, includes a pivot ball allowing the trucks 482 and 492 to easily glide through the C-channel of the track assembly 412 and 422 as well as rotate about the ball bearing. The first pack 480 and second pack 490 are locked in the back position and front position by a stopper, friction lock, or other methods as described above. As separate packs, the first pack 480 and second pack 490 may be moved independently.

Figure 16:
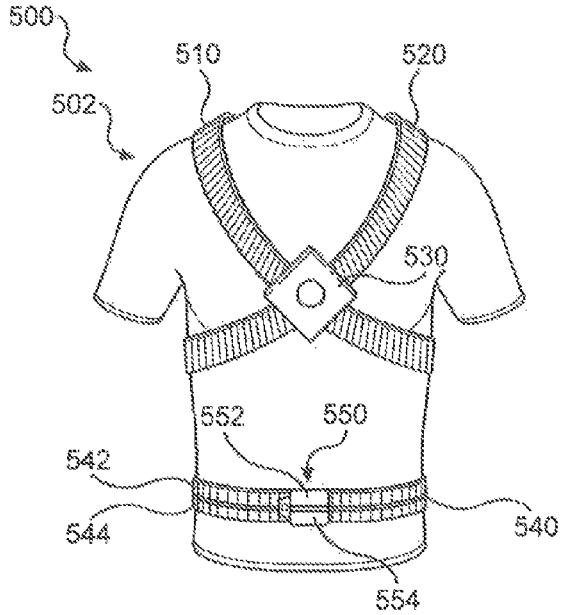
FIG. 16 is a front view of an alternative embodiment of the Front-Back Pack showing notched shoulder belts crossing the chest area of a user and attached with a chest piece.

Referring now to FIG. 16, a front view of an alternative embodiment of the Front-Back Pack is shown and generally designated 500. The Front-Back Pack 500 includes a belt harness system 502, first pack 580 (not shown), and second pack 590 (not shown).

The belt harness system 502 has a first shoulder belt 510 and a second shoulder belt 520 connected together at an orthogonal angle by a chest piece 530. The first shoulder belt 510 is a belt having equally spaced notches spanning the entire length of the belt. The notches allow the belt to advance a predetermined distance from one notch to the next. The chest piece 530 includes a locking mechanism which prevents first shoulder belt 510 to advance without the use of force and further allows the first shoulder belt 510 to be locked to prevent movement. At an orthogonal angle, second shoulder belt 520 is inserted into the chest piece 530. First shoulder belt 510 and second shoulder belt 520 is substantially similar. The crisscross pattern of the belt harness system 502 provides Front-Back Pack 500 with the stability and strength to keep the attached first pack 580 and second pack 590 firmly against the body of the user.

A belt 540 having a buckle 550 is attached to first pack 580 and second pack 590. The belt 540 prevents the first pack 580 and second pack 590 from separating from a user's body when in use by providing a second connection point, the first connection point being the belt harness system 502. The belt 540 includes first strap 542 and second strap 544. First strap 542 forms a loop connected by first strap buckle 552 and second strap 544 forms a loop connected by second strap buckle 554. First strap buckle 552 and second strap buckle 554 interlocks and connects into a single buckle 550. By interlocking the buckle 550, it prevents the first strap 542 and second strap 544 from moving relative to one another.

First strap 542 is attached to first pack 580 and second strap 544 is attached to second pack 590. First strap 542 and second strap 544, with the buckle 550 released from being interconnected, can rotate around a user's body in separate directions. Loosening the belt 540 allows a user to rotate the first pack 580 and second pack 590 without the need to remove the packs from the user's body.

Figure 17:
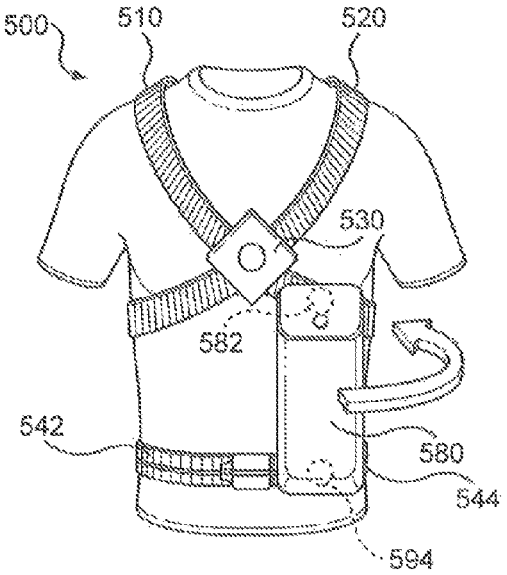
FIG. 17 is front view of the alternative embodiment of FIG. 16 showing a first pack transitioning from the back position by sliding the notched shoulder belt through the chest piece and rotating the attached belt.

Referring now to FIG. 17, a front view of the Front-Back Pack 500 is shown. The first pack 580 is in the front position. The first pack 580 is connected to the first shoulder belt 510 with the use of a hinge 582 which allows articulation of the pack, and is connected to first strap 542 by hinge 584 which also allows articulation. Rotating the first pack 580 from the front position to the back position advances the first shoulder belt 510 through the chest piece 530 and rotates the first strap 542 around a user's body. Rotating first pack 580 around the body stretches and compacts first pack 580 to accommodate the change in distance between the first shoulder strap 510 and first strap 542. Additionally, the shoulder strap 510 and first strap 542 also shifts to accommodate the change in distance as the pack moves.

Figure 18:
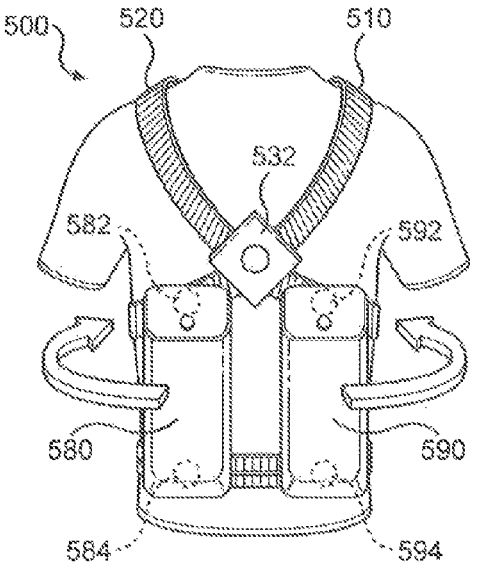
FIG. 18 is a back view of the alternative embodiment of FIG. 16 showing the first and a second pack.

Referring now to FIG. 18, a back view of the Front-Back Pack 500 is shown. The first shoulder belt 510 and first shoulder belt 520 is further connected by a back piece 532 which is substantially similar to chest piece 530. The back piece 532 includes a mechanism which prevents the belts from advancing without the use of force, however does not lock. The first pack 580 is connected to the first shoulder belt 510 by hinge 582 and first strap 542 by hinge 584. The second pack 590 is connected to second shoulder belt 520 by hinged 592 and second strap 544 by hinge 594. The packs rotate to the front position in opposite directions by rotating under the user's arms.

Figure 19:
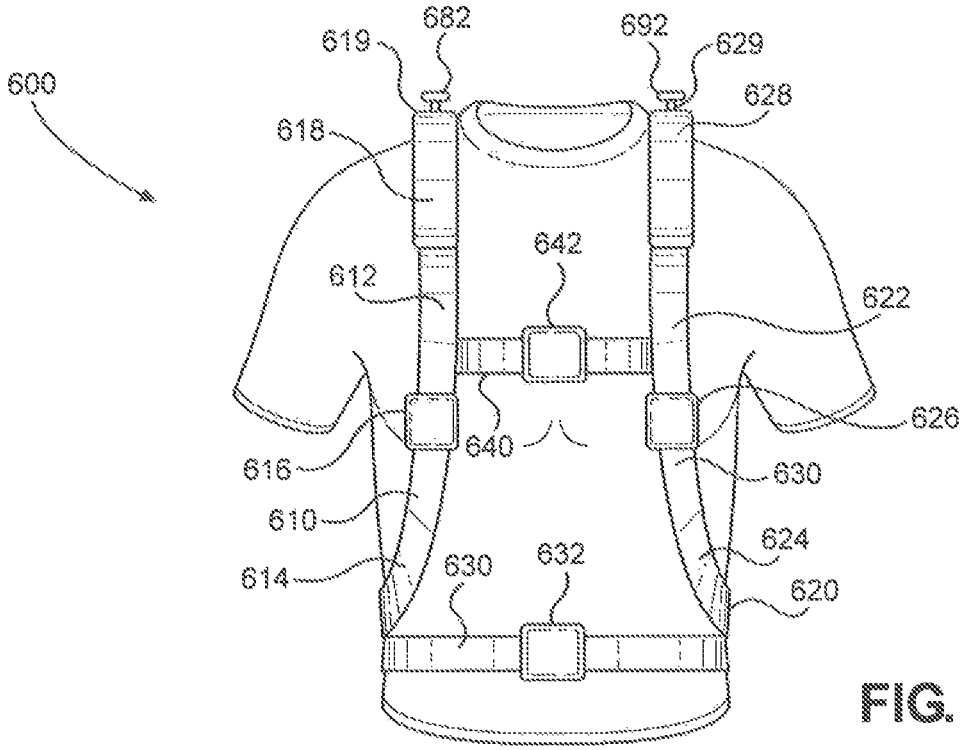
FIG. 19 is a front view of an alternative embodiment of the Front-Back Pack showing the shoulder straps with shoulder mounts having packs rotatably attached to the shoulder mounts.

Referring now to FIG. 19, a front view of an alternative embodiment of the Front-Back Pack of the present invention is shown and generally designated 600. The Front-Back Pack 600 includes a harness system 602, a first pack 680, and a second pack 690.

The harness system 602 includes a first shoulder strap 610, a second shoulder strap 620, and a belt 630. The first shoulder strap 610 extends from the front of the belt 630 to the back of the belt 630. The first shoulder strap 610 includes a stationary strap 612 and an adjustable strap 614. One end of the stationary strap 612 is rigidly attached to the back of the belt 630 and the opposite end terminates into an adjustable slide 616. The adjustable strap 614 is rigidly attached to the front of the belt 630 and is connected to the adjustable slide 616 to form the first shoulder strap 610. At the apex of the first shoulder strap 610, a shoulder mount 618 is fixedly attached. The shoulder mount 618 is made from a flexible, durable, and rigid material such as a polymer, plastic, rubber, metal or any other material with similar physical properties. Attached to the shoulder mount 618 is a stud 619 to receive socket 682. The rigidity of the shoulder mount 618 prevents the shoulder strap 618 with attached stud 619 and socket 682 from sliding off of a user's shoulder. The second shoulder strap 620 is substantially the same and includes a stationary strap 622, adjustable slide 626, adjustable strap 624, shoulder mount 628, stud 629, and socket 692.

A sternum strap 640 attaches the first shoulder strap 610 with the second shoulder strap 620. The sternum strap 640 has a buckle 642 which allows the adjustment of the length of the sternum strap 640 and to disconnect. The belt 630 is formed with a buckle 632 at the midpoint. The buckle 632 allows the length of the belt 630 to be adjusted and to disconnect the belt 630. By disconnecting the sternum strap 640 and belt 630, the harness system 602 is quickly and easily removed.

Figure 20:
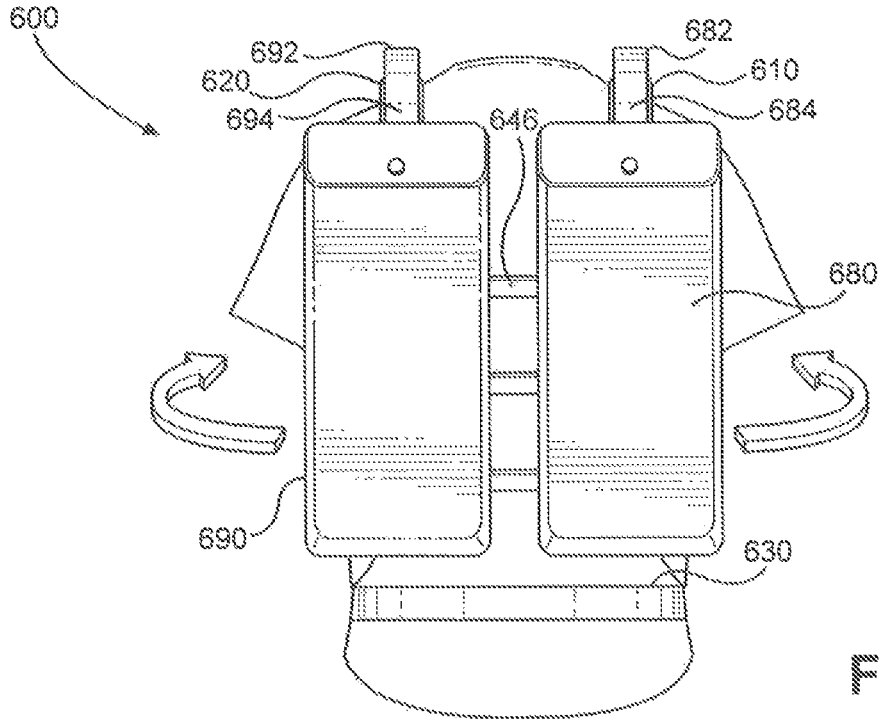
FIG. 20 is back view of the alternative embodiment of FIG. 19 showing a first pack attached to a shoulder mount and a second pack attached to an alternate shoulder mount.

Referring now to FIG. 20, a back view of the Front-Back Pack 600 is shown. The first pack 680 is rigidly attached to a frame 684. The frame 684 extends the length of the first pack 680 and extends further and gradually bends perpendicular to the first pack 680. The frame 684 is made from a single piece of solid material formed into the adequate shape such as reinforced plastic, polymer, metal or other similar material with similar properties. The frame 684 may be made alternatively made of a system of interconnected members. At the end of the frame 684, a socket 682 is rigidly attached. The socket 682 is rotatably attached to stud 619, allowing the frame 684 with attached first pack 680 to rotate from the back position to the front position. The second pack 690 is substantially similar to the first pack 680 and includes a frame 694 with an attached socket 692. To provide additional strength and stability, a plurality of back straps 646 connect first shoulder strap 610 and second shoulder strap 620.

Figure 21:
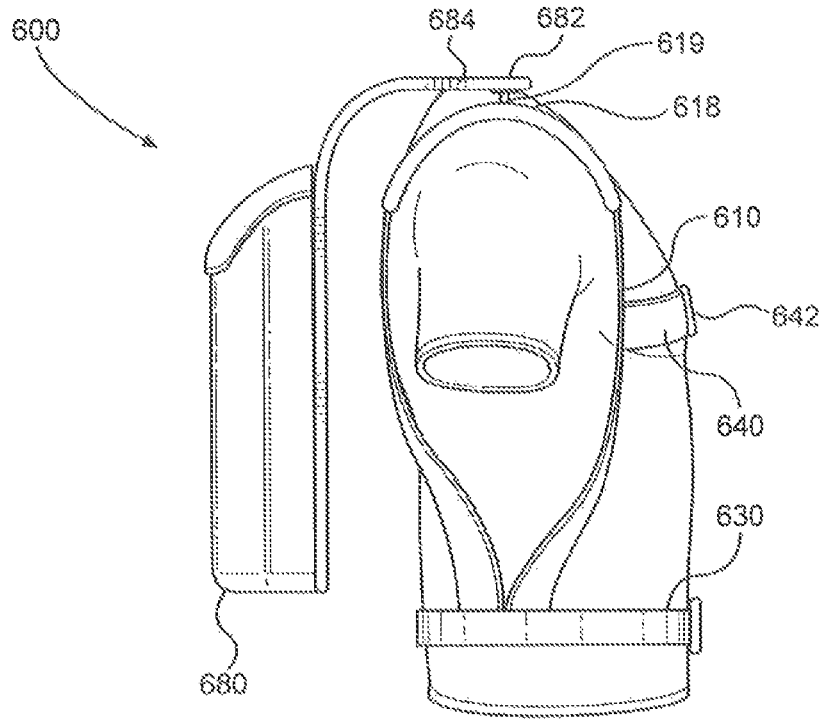
FIG. 21 is a side view of the alternative embodiment of FIG. 19.

Referring now to FIG. 21, a side view of the Front-Back Pack 600 is shown. The first pack 680 is connected to frame 684 with socket 682 attached to stud 619. The stud 619 is attached to shoulder mount 618. The first pack 680 rotates about stud 619 from the back position to the front position. Integrated into socket 682 is a lock mechanism, locking the socket 682 and attached frame 684 and first pack 680 in the back position or front position.

Figure 22:
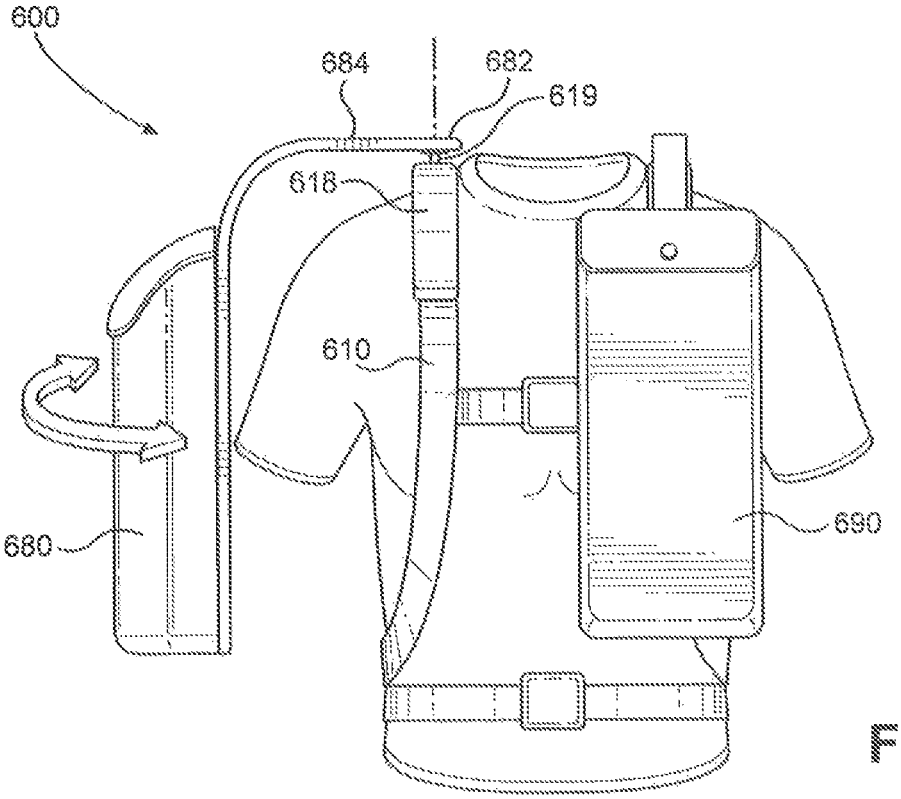
FIG. 22, is a front view of the alternative embodiment of FIG. 19, showing the first pack being transitioned from the back position to the front position by rotating about the shoulder pad over the outer arm of the user.

Referring now to FIG. 22, a front view of the Front-Back Pack 600 is shown. The first pack 680 is shown being transitioned from the back position to the first position by rotating about the stud 619. The frame 684 and attached first pack 680 rotates around the shoulder and arm of a user with adequate clearance to prevent the frame 684 from coming into contact.

Figure 23:
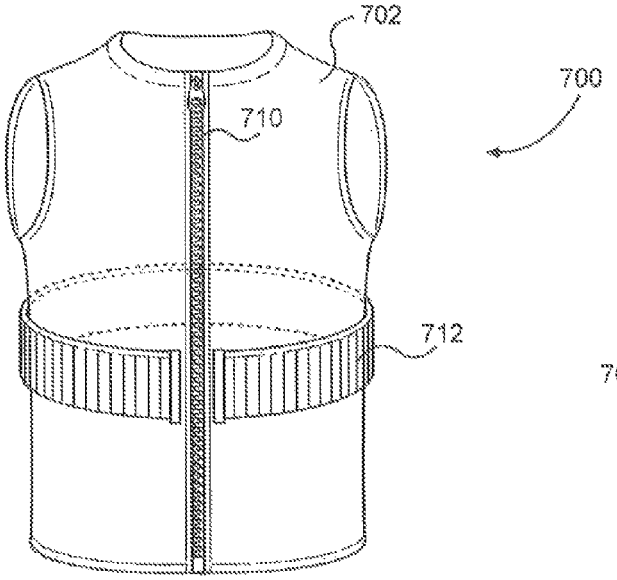
FIG. 23 is front view of an alternative embodiment of the Front-Back Pack of the present invention, showing the full vest with attached track.

Referring now to FIG. 23, an alternative embodiment of the Front-Back Pack of the present invention is shown and generally designated 700. The Front-Back Pack 700 includes a full vest 702 having a zipper 710 splitting the vest 702 into a first half and a second half. Attached to the vest 702 is a track 712. The track 712 has a first end and a second end, where the first end is attached adjacent to the zipper 710 of the first half of the vest and the second end is attached adjacent to the corresponding zipper portion of the second half of the vest. The track 712 is attached to the back of the vest 702 at the center of the track 712. As a result, the track 712 is split into equal portions, each portion attached at two points.

Figure 24:
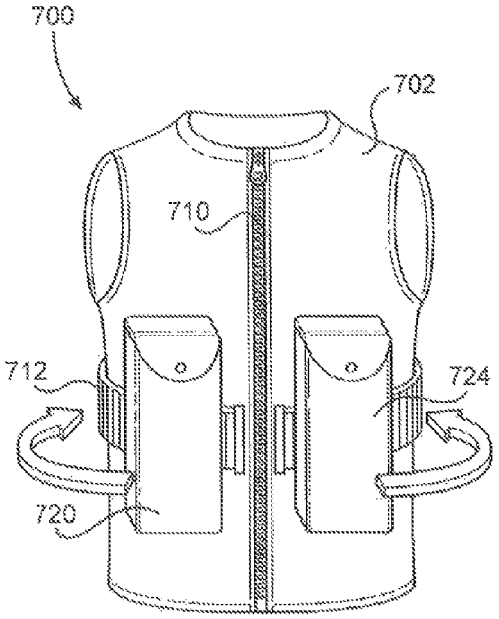
FIG. 24 is a front view of the alternative embodiment of FIG. 23, showing the first and second pack attached to the track and in the front position.

Referring now to FIG. 24, a front view of the Front-Back Pack 700 is shown. Attached to the track 712 is first pack 720 and second pack 724. The first pack 720 is attached to first region of the track 712 by the use of a loop 722 (not shown) attached to the first pack 720. The track 712 is inserted into loop 722 and allows the loop 722 and attached pack 720 to traverse the track 712 from the back position to the front position. Second pack 724 has an attached loop 626 (not shown) and is attached to the second region of track 712 in a similar manner as the first pack. The first end and the second end of the track 712 terminate at zipper 710. By terminating at zipper 710, the vest 702 can be removed by simply unzipping zipper 710 while still retaining the packs within the track 712.

Figure 25:
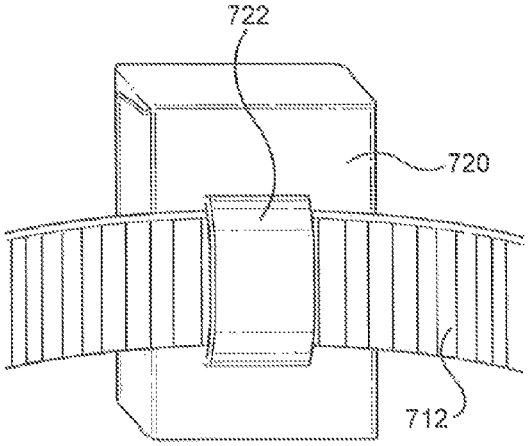
FIG. 25 is a close-up back view of the pack of FIG. 23, showing the track inserted through the loop of the pack.

Referring now to FIG. 25, a rear view of first pack 720 is shown. The first pack 720 has attached loop 722. The track 712 and loop 722 is made of a rigid material such as a polymer, metal, fabric, or any other type of material with similar physical properties. The track 712 is inserted into loop 720 and loop 720 easily traverses track 712 without significant force while maintaining enough friction to remain in a stationary position when not acted upon.

Figure 26:
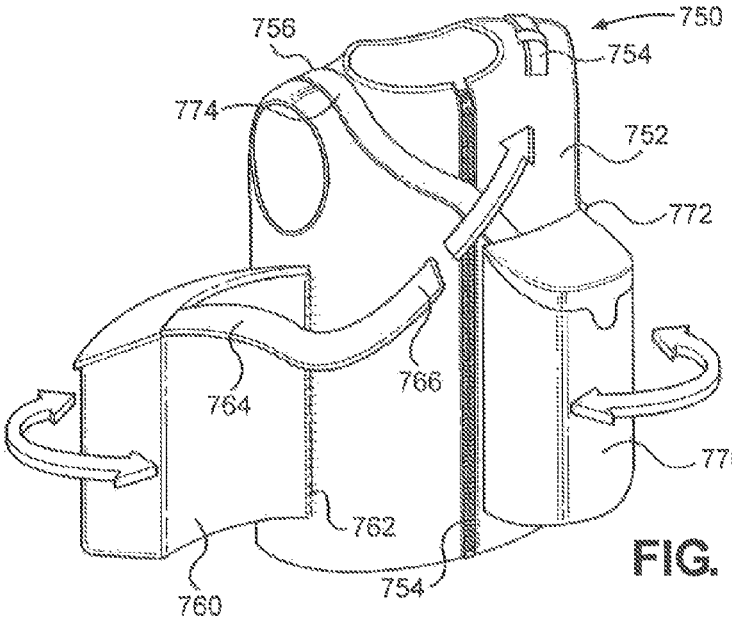
FIG. 26 is a perspective view an alternative embodiment of the Front-Back Pack of the present invention, showing a vest with hingedly attached packs on both sides of the vest.

Referring now to FIG. 26, a perspective view of an alternative embodiment of the Front-Back Pack of the present invention is shown and generally designated 750. Front-Back Pack 750 includes a full vest 752 having a zipper 754 in the front. On each side of vest 752 a pack is attached. Attached to the shoulders of the vest are Velcro pads 754 and 756. The first pack 760 is amorphous and made of a durable, strong material such as nylon, cotton, polyester, or similar material with similar physical characteristic. Attached to one side of the first pack 760 is a hinge 762 and attached to the top is a strap 764. Opposite of the attachment point of strap 764 is Velcro 766. The hinge 762 is attached to the side of a user adjacent and underneath an armhole of the vest 752. The hinge 762 allows the pack to swivel and rotate about the hinged 762 to a front or back position. The second pack 770 is substantially similar to first pack 760 and includes a swivel 772 and strap 774 with attached Velcro 776.

As shown, the first pack 760 is being transitioned from the back position to the front position. The Velcro 766 of strap 764 of first pack 760 is disconnected from the Velcro pad 754 and rotates along the hinge 762 to the front where Velcro 766 of strap 764 is attached to Velcro pad 754 which holds the first pack 760 in place. The use of Velcro is not meant to be limiting and other similar fasteners such as buttons, snap buttons, buckles, or similar fasteners. When in position, the first pack 760 is shaped to fit the body of the user as shown by second pack 770.

Figure 27:
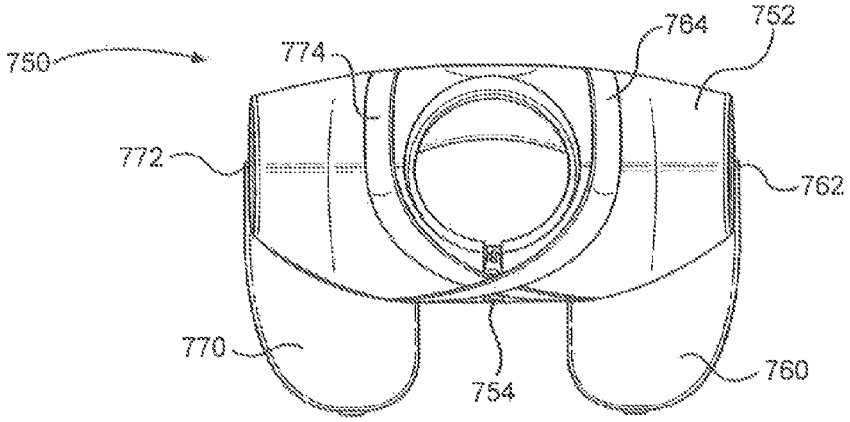
FIG. 27 is a top view of the alternative embodiment of FIG. 26, showing the packs in the back position and held in place by the hinges and shoulder straps.

Referring now to FIG. 27, a top view of the Front-Back Pack 750 is shown. The first pack 760 and second pack 770 are in the front position and held firmly in place. The first pack 760 and second pack 770 deforms and fit tight against the user's body. The strap 764 of first pack 760 is attached in place by attaching Velcro 766 to Velcro pad 754. The strap 774 of first pack 770 is attached in place by attaching Velcro 776 to Velcro pad 756.

Figure 28:
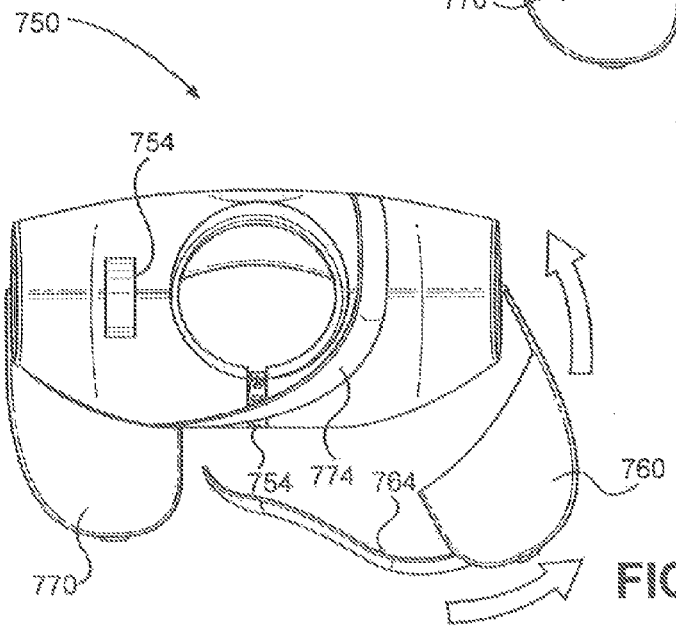
FIG. 28 is a top view of the alternative embodiment of FIG. 26, showing a pack in the back position and the alternative pack being transitioned from the back position to the front position.

Referring now to FIG. 28, a top view of the Front-Back Pack 750 is shown. As shown, the first pack 760 is being transitioned from the front position to the back position. The Velcro 766 of strap 764 of first pack 760 is disconnected from the Velcro pad 754 and rotates along the hinge 762 to the front where Velcro 766 of strap 764 is attached to Velcro pad 754 which holds the first pack 760 in place. As the first pack 764 is transitioned from the front position to the back position, the first pack 760 deforms as the strap 764 is pulled towards the back position and vice versa.

Figure 29:
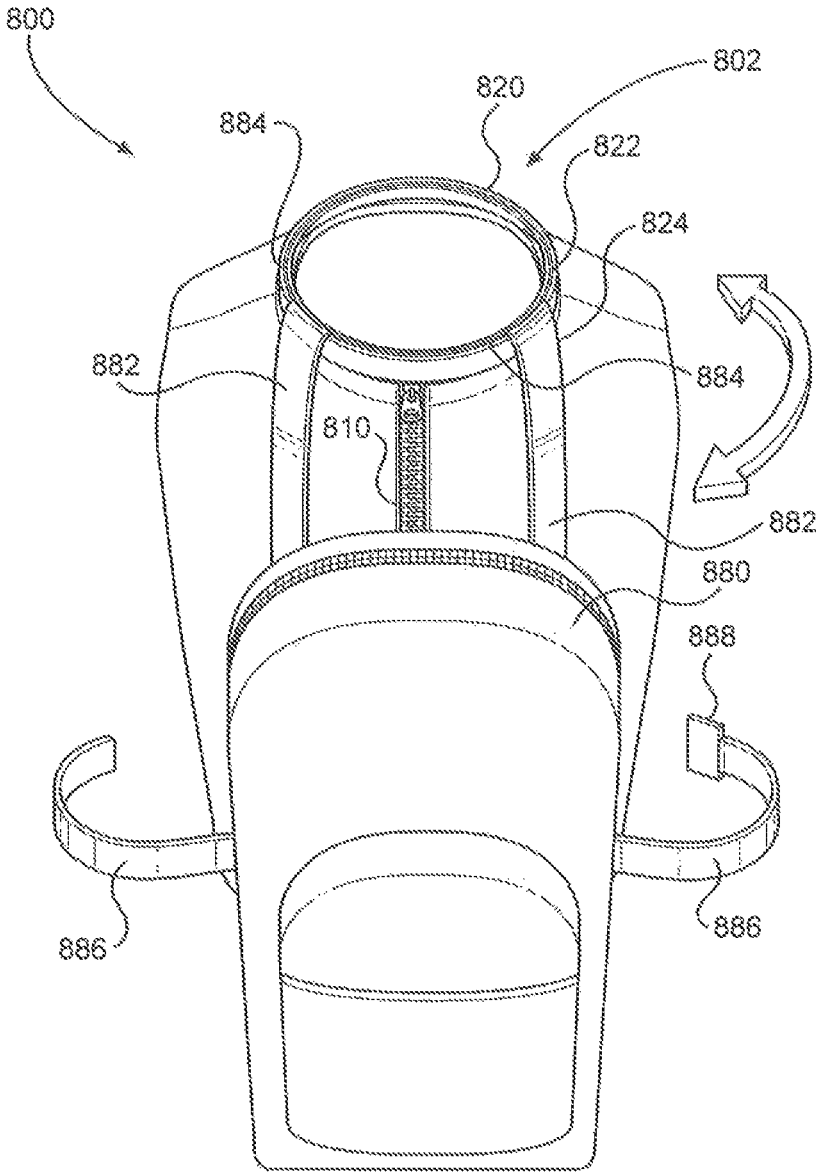
FIG. 29 is front view an alternative embodiment of the Front-Back Pack of the present invention, showing a vest having a neck track with a pack attached to the neck track, allowing the pack to traverse along the neck track.

Referring now to FIG. 29, a front view of an alternative embodiment of the Front-Back Pack is shown and generally designated 800. The Front-Back Pack 800 includes a full vest 802 having a zipper 810. Attached to the vest 802 is a neck track 820 located around the neck of the vest 802. Neck track 820 comprises a backing 824 with an attached track assembly 822. The track assembly 822 is substantially similar to track assembly 142 of FIG. 6. The neck track 820 has a first end and a second end, where the first end is attached adjacent to the zipper 810 and the second end is attached adjacent to and on the opposite side of the zipper 810, such that the zipper 810 is placed in a gap of the slide rail assembly 820. This allows the neck track 820 and full vest 802 to part at the zipper 810.

Pack 880 has two attached shoulder straps 882 located at the top of pack 880. Opposite the attached end of shoulder straps 882 is attached a truck 884. The truck 884 is substantially similar to the truck 482 of FIG. 14. The truck 884 is inserted into the track assembly 822 and allows the pack 880 to traverse the neck track 820 from a front position to a back position. To secure the pack 880 to the user's body, a belt 886 with an adjustable buckle 888 is attached to the bottom of pack 880.

Figure 30A:
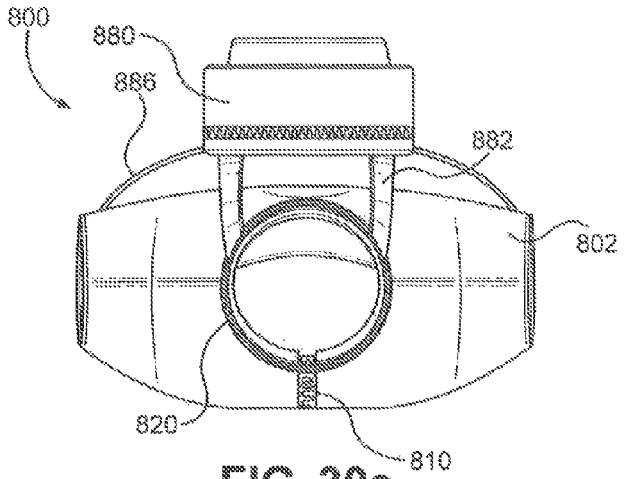
FIG. 30*a*-30*c* is a top view of the alternative embodiment of FIG. 29 showing the various stages of the pack being transitioned from a back position to a front position.

Referring now to FIG. 30*a*, a top view of the Front-Back Pack 800 of the present invention is shown. As shown, pack 880 is in the back position and the adjustable buckle 888 of belt 886 is attached to prevent the pack 880 from moving.

Figure 30B:
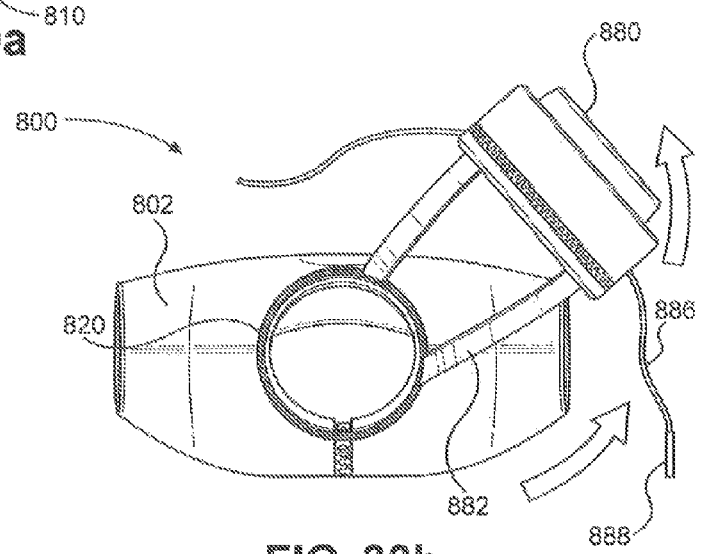

Referring now to FIG. 30*b*, a top view of the Front-Back Pack 800 of the present invention is shown being transitioned from the back position to the front position. The adjustable buckle 888 is released separating the belt 886, allowing the pack 880 to freely traverse the neck track 820.

Figure 30C:
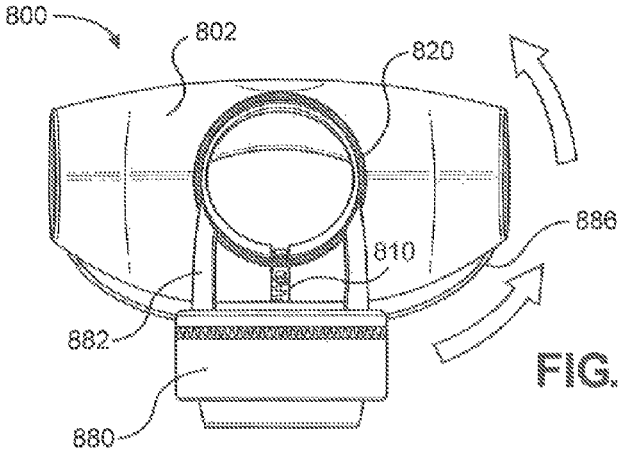

Referring now to FIG. 30*c*, a top view of the Front-Back Pack 800 of the present invention is shown in the front position. In the front position, the adjustable belt 886 can be attached by buckling adjustable buckle 888 to prevent the pack 880 from moving.

While there have been shown what are presently considered to be preferred embodiments of the present invention, it will be apparent to those skilled in the art that various changes and modifications can be made herein without departing from the scope and spirit of the invention.

What is claimed is:

1. A front-back pack comprising:

a harness system comprising a first shoulder strap assembly having an upper portion and a lower portion, a second shoulder strap assembly having an upper portion and a lower portion, an upper slide rail assembly attached to said upper portion of said first shoulder strap assembly and said second shoulder strap assembly, and a lower slide rail assembly attached to said lower portion of said first shoulder strap assembly and said second shoulder strap assembly, wherein said first shoulder strap crosses over itself to form an X-shaped pattern between said upper slide rail assembly and said lower slide rail assembly, and wherein said second shoulder strap crosses over itself to form an X-shaped pattern between said upper slide rail assembly and said lower slide rail assembly;

a storage compartment attached to said upper slide rail assembly and said lower slide rail assembly of said harness system and capable of traversing the upper slide rail assembly and lower slide rail assembly between a front position and a back position; and wherein traversing said storage compartment to the front position leaves the back position free of the storage compartment.

2. The front-back pack of claim 1, wherein said slide rail assembly comprises a track assembly attached to a backing having a first end with a slide buckle and a second end with an adjustable strap, wherein said adjustable strap is inserted into said slide buckle forming an adjustable loop.

3. The front-back pack of claim 2, wherein said storage compartment has a plurality of sliding structures rigidly attached to said storage compartment.

4. The front-back pack of claim 3, wherein each said sliding structure comprises a body having a short member and a long member, at least one rotating member attached to said short member and said long member rigidly attached to said pack, wherein said sliding structure is received by said track assembly and allowing said sliding structure to traverse said track assembly.

5. The front-back pack of claim 4, wherein said track assembly comprises a plurality of tracks formed with a C-section and a flange, wherein each track is linearly lined along said backing and separated by a predetermined gap.

6. The front-back pack of claim 1, wherein the harness system further comprises a mesh panel attached to said first shoulder strap assembly and said upper rail assembly.

* * * * *